US009568236B1

(12) United States Patent
Laskowski

(10) Patent No.: US 9,568,236 B1
(45) Date of Patent: Feb. 14, 2017

(54) APPARATUS FOR COVERING A CONTAINER

(76) Inventor: Judith Arline Laskowski, Fort Worth, TX (US)

( * ) Notice: Subject to any disclaimer, the term of this patent is extended or adjusted under 35 U.S.C. 154(b) by 0 days.

(21) Appl. No.: 13/457,805

(22) Filed: Apr. 27, 2012

Related U.S. Application Data

(60) Provisional application No. 61/480,523, filed on Apr. 29, 2011.

(51) Int. Cl.
*F25D 3/00* (2006.01)
*F25D 3/08* (2006.01)
*B67D 1/08* (2006.01)

(52) U.S. Cl.
CPC ..... *F25D 3/08* (2013.01); *B67D 1/0857* (2013.01)

(58) Field of Classification Search
CPC ... B67D 1/0857; B67D 1/06; F25D 2331/802; F25D 2303/081; F25D 3/08
USPC 222/108, 146.6, 192, 183; 141/174; 62/389, 400, 457.1, 371; 248/302, 213.2, 248/99; 206/515; 220/756
See application file for complete search history.

(56) References Cited

U.S. PATENT DOCUMENTS 653,567 A * 7/1900 Collins ..... 62/459
885,475 A * 4/1908 Hitchoock ..... 220/501
1,334,664 A * 3/1920 Martin ..... 248/302
1,349,473 A * 8/1920 Rosenthal ..... 248/302
1,377,630 A * 5/1921 Royster ..... 222/108
1,782,720 A * 11/1930 Franklin ..... 62/338
2,003,050 A * 5/1935 Iselin ..... F25D 3/02 222/131
2,481,719 A * 9/1949 Buck ..... 222/108
2,739,739 A * 3/1956 Steele ..... 222/243
2,792,692 A * 5/1957 Bryan ..... B67D 1/04 222/146.6
3,586,074 A * 6/1971 Snyder ..... 141/121
4,164,853 A * 8/1979 McDonough ..... 62/457.1
4,220,048 A * 9/1980 Grepiotis et al. ..... 73/323
4,234,101 A * 11/1980 Pastore ..... A47F 1/065 221/241
4,350,267 A * 9/1982 Nelson et al. ..... 222/131
4,424,687 A * 1/1984 Morgan ..... 62/457.1
4,478,346 A * 10/1984 Spong ..... 220/711
4,481,791 A * 11/1984 German ..... 62/400
4,633,678 A * 1/1987 Lea et al. ..... 62/457.1
D290,679 S * 7/1987 Thorpe ..... D7/397
4,809,734 A * 3/1989 Cliff ..... 137/312
5,067,633 A * 11/1991 Grosz ..... B65D 83/0038 221/279
5,129,552 A * 7/1992 Painchaud et al. ..... 222/146.6
5,203,181 A * 4/1993 Brossia ..... B65D 7/045 220/592.19
5,282,561 A * 2/1994 Mihalich ..... B67D 1/0857 222/146.6

(Continued)

*Primary Examiner* — Paul R Durand
*Assistant Examiner* — Charles P Cheyney
(74) *Attorney, Agent, or Firm* — Hitchcock Evert LLP

(57) ABSTRACT

A container covering apparatus provides a structural work surface and has an opening to access operational components of a container. The container cover also provides attachment elements to attach the cover to a container or a receptacle holding the container. The container cover further includes an accessory support element. An embodiment designed to cover a beverage container within a receptacle, wherein the surface is used in serving beverages, the opening allows for access to a beverage dispensing mechanism, and the accessory support holds empty cups for serving the beverage.

16 Claims, 5 Drawing Sheets

(56) References Cited

U.S. PATENT DOCUMENTS

| | | | | |
|---|---|---|---|---|
| 5,564,605 | A * | 10/1996 | Heidbreder | A63B 55/00 222/192 |
| 6,189,720 | B1 * | 2/2001 | Gillispie | 220/571 |
| 6,481,238 | B1 * | 11/2002 | Jennings et al. | 62/457.4 |
| 6,751,981 | B1 * | 6/2004 | Burnette | 62/457.2 |
| 7,225,951 | B2 * | 6/2007 | Wempe et al. | 222/192 |
| 8,091,378 | B1 * | 1/2012 | Farias et al. | 62/389 |
| 8,839,812 | B2 * | 9/2014 | Tanhehco et al. | 137/312 |
| 2008/0237260 | A1 * | 10/2008 | Wolek | 222/105 |
| 2009/0044876 | A1 * | 2/2009 | Doglioni Majer | 141/1 |
| 2010/0018994 | A1 * | 1/2010 | Antheil et al. | 222/105 |
| 2010/0077790 | A1 * | 4/2010 | Apps | 62/372 |
| 2010/0264140 | A1 * | 10/2010 | Apps | 220/200 |

* cited by examiner

APPARATUS FOR COVERING A CONTAINER

CROSS-REFERENCE TO RELATED APPLICATION

This application claims the benefit of priority from U.S. Provisional Application No. 61/480,523 filed on Apr. 29, 2011.

FIELD OF THE DISCLOSURE

The disclosure relates to an apparatus for at least partially covering a container. The disclosure further relates to an apparatus to partially cover a liquid dispenser while allowing access to at least a portion of the dispenser.

BACKGROUND

Devices such as a variety of pumps have been attached to containers to dispense liquids from the containers. For example, a pump may be attached to the top of a beverage container in order to dispense the beverage into smaller containers for consumption. Often a beverage container may be placed into a larger receptacle that can be used to cool the beverage container and/or for aesthetic purposes. For example, a beverage container known as a keg may be placed in a larger receptacle, such as a trash can, and surrounded by ice to keep the keg and its liquid contents cold.

Some people have covered such a container located in a larger receptacle by cutting a hole in the standard cover for the receptacle to accommodate a pump and placing the cover over both the beverage container and the receptacle. However, such covers have drawbacks often associated with the original design as a complete cover to the receptacle without a hole. For example, such covers do not provide a surface to efficiently serve beverages from the beverage container. For another example, such covers may be too structurally weak to support common items associated with serving beverages, such as serving containers filled with the beverage, and the standard cover may be further weakened by the hole cut into the cover.

SUMMARY

The present disclosure describes embodiments of a container cover that meets the needs of dispensing and supplying liquids efficiently. For example, embodiments disclose a covering apparatus that is structurally capable of supporting beverage serving items such as pitchers or cups when they are filled with the beverage. Embodiments further disclose an apparatus that provides access to the dispensing device. Some embodiments further include cup, pitcher, or utensil holding structures.

Additional aspects, advantages and features of the present invention are included in the following description of exemplary examples thereof, which description should be taken in conjunction with the accompanying figures, wherein like numerals are used to describe the same feature throughout the figures.

A BRIEF DESCRIPTION OF THE DRAWINGS

DETAILED DESCRIPTION

While this invention may be embodied in many different forms, there will herein be described in detail embodiments of the invention with the understanding that the present disclosure is to be considered as an exemplification of the principles of the invention and is not intended to limit the broad aspects of the invention to the embodiments illustrated. It will be understood that the invention may be embodied in other specific forms without departing from the spirit or central characteristics thereof. The present embodiments, therefore, are to be considered in all respects as illustrative and not restrictive, and the invention is not to be limited to the details given herein.

Figure 1:
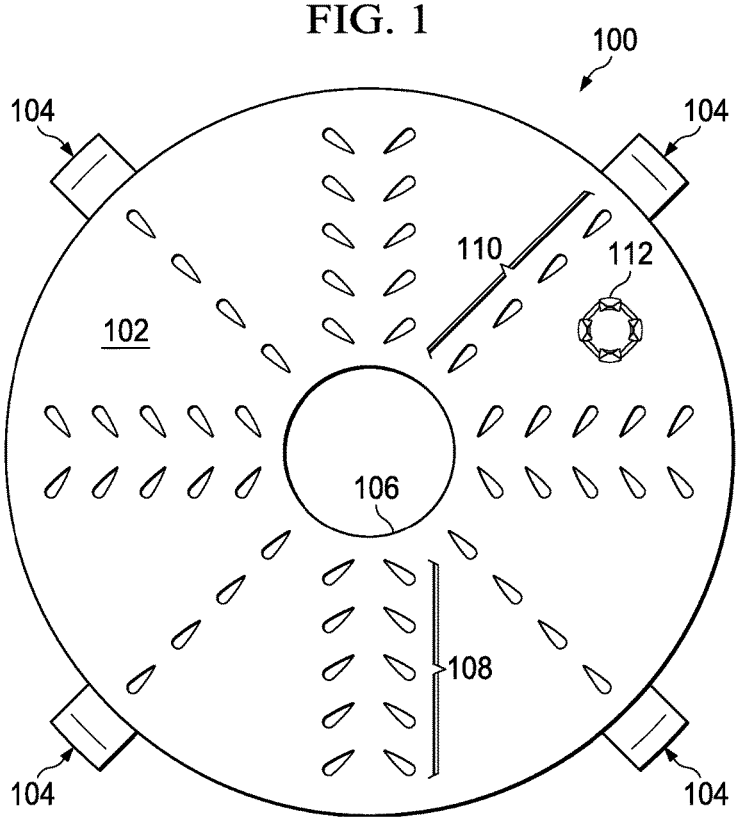
FIG. 1 is a top view of a first embodiment.
Figure 2:
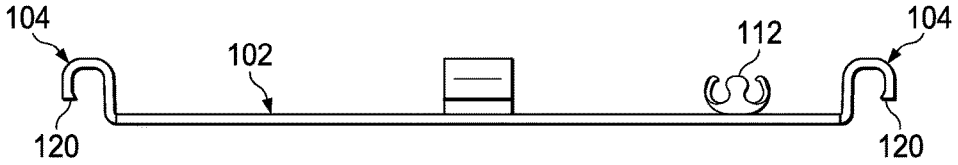
FIG. 2 is a side view of the first embodiment.

An embodiment of the invention is shown in FIGS. 1 and 2. Cover 100 includes a main body 102 which is depicted as a circular shape, but the shape may be altered and remain within the scope of the disclosure. Main body 102 may be constructed of a metal plate, reinforced plastic, or any other material to provide sufficient strength to support item associated with the use of the cover 100. For example, main body 102 may be constructed with a sanitary grade metal that provides sufficient structural support and cleanliness for the beverage service items such as cups, pitchers, and ice containers.

The cover 100 also includes attachment means to hold the cover 100 in place over the container (not shown). One skilled in the art will recognize that the attachment means may be any device or apparatus that connects the cover 100 to the container (not shown) or to a receptacle (not shown) which holds the container (not shown). In this embodiment, attachment means are hooks 104 which are located at the exterior edge of main body 102. Although four hooks 104 are shown in this embodiment, the number and design of the hooks 104 may vary and remain within the scope of the invention. One skilled in the art will recognize that the stability of the cover 100 may be altered by altering the number of hooks 104 or width of the hooks 104.

As shown in FIG. 2, hooks 104 extend vertically from main body 102 allowing main body 102 to be recessed from the structure to which the hooks 104 attach. When the cover 100 is attached to and within a receptacle (not shown) the recessed position of main body 102 helps to contain any spills within the receptacle (not shown). In addition, hooks 104 are shown with protrusions 120 which may aid in maintaining the position of cover 100 and preventing accidental removal of hooks 104. Hooks 104 may be constructed as a single form with main body 102 or may be attached by any means, including but not limited to bolts, rivets, adhesives, and welding. Hooks 104 may also be designed as separate components that may be removably connected to (e.g. a tongue and groove or snap connection) or used in conjunction with main body 102 to provide support (e.g. the hook 104 has an L shape wherein one side extends under the main body 102 to provide support). In addition, hooks 104 and main body 102 may be adjustable to fit containers with varying dimensions.

Opening 106 is located within the main body 102 and provides access to operational components of the liquid dispenser (not shown). Opening 106 is also shown as a circle, but may be any shape that provides sufficient operation access to the liquid dispenser (not shown). In addition, placement of opening 106 may be varied according to the liquid dispenser (not shown) operation or for aesthetic purposes.

Main body 102 includes drainage options to prevent spilled liquids from gathering on the useable surface. In the food industry this increases sanitation. In some industries the drainage may be used in conjunction with a reclamation option if the dispensed liquid is reusable. In this embodiment, drainage options include the dual drainage holes 108 and the single drainage holes 110. One skilled in the art will recognize that the selection of drainage options and designs may vary and remain within the scope and spirit of the disclosure.

Accessory support 112 is also located on main body 102. Accessory support 112 may be designed to support various accessories that may be employed in conjunction with the liquid dispenser (not shown). In this embodiment, accessory support 112 is designed as a container holder to support a stack of empty containers (not shown) for use in serving the selected liquid. As shown in FIG. 2, accessory support 112 comprises a raised set of prongs that bow outward from center. Accessory support 112 may be designed such that the bowed exterior of accessory support 112 provides pressure against the interior of an empty serving container (not shown) to help prevent the container from tipping over. Similar to hooks 104, accessory support 112 may be constructed as a single form with main body 102 or may be permanently or removably attached by any means.

Figure 3:
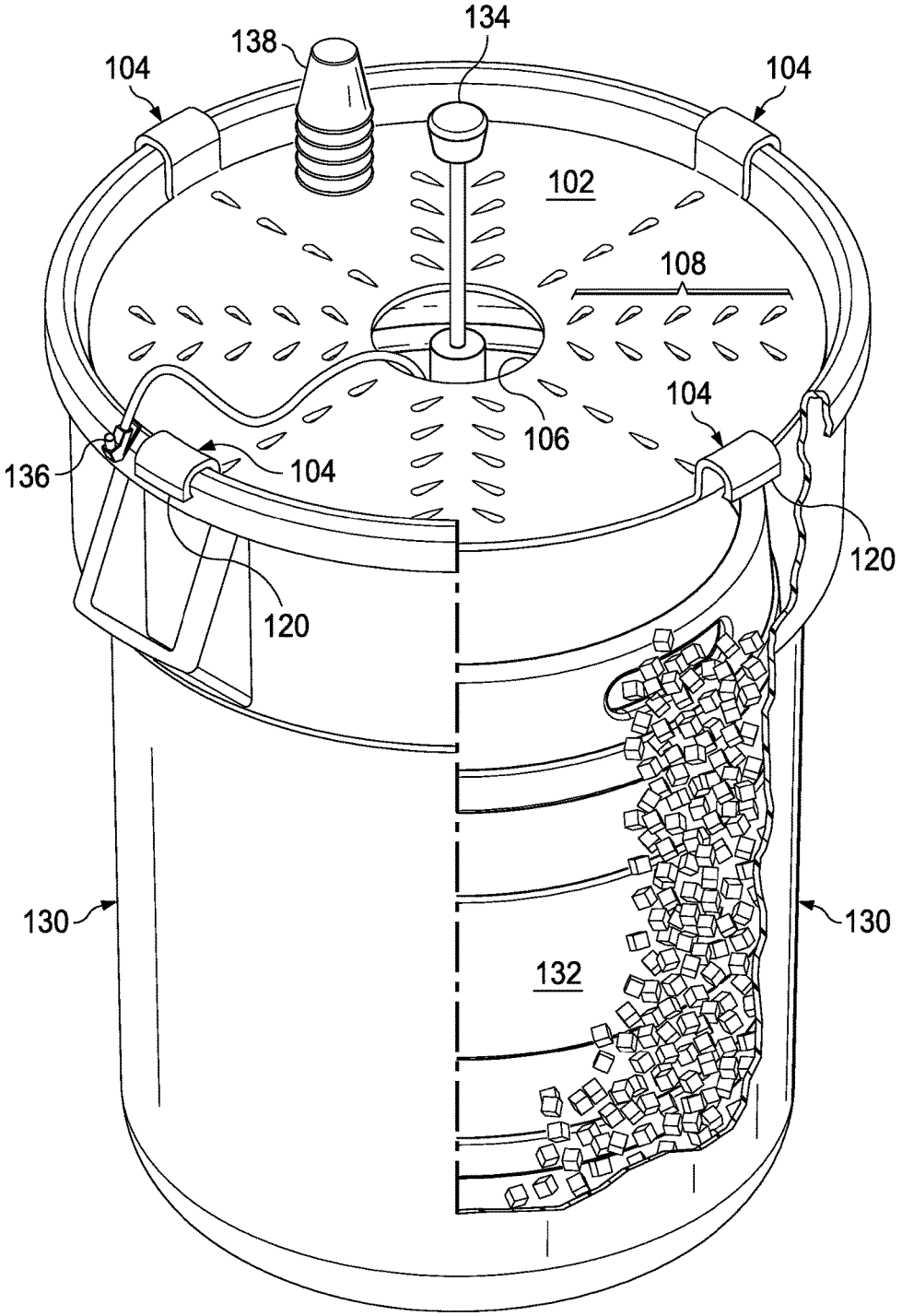
FIG. 3 is a perspective view of an embodiment in application.

FIG. 3 depicts cover 100 shown in FIGS. 1 and 2 as part of a beverage service operation. Cover 100 is depicted within receptacle 130 and held in place by hooks 104. Receptacle 130 is shown with a cut-away section to depict the contents within receptacle 130 and the placement of cover 100. Inside receptacle 130 is beverage container 132. As an example, beverage container 132 may be a keg of beer and receptacle 130 may be a trash can.

Attached to the top of the beverage container is a dispenser having pump handle 134 and output spout 136. Pump handle 134 and output spout 136 extend through opening 106 of the main body 102 and may be used to operate the dispenser in this embodiment. As one skilled in the art will recognize, other dispensers may utilize alternative or additional operational components which may extend through or be accessed through opening 106 and remain within the scope and spirit of the disclosure.

Container stack 138 is shown on top of main body 102 and is located on top of accessory support 112. Accessory support 112 supports all containers that make up container stack 138 through the engagement of the bottom container.

During use the pump handle 134 may be operated to maintain a pressure within the beverage container 132. A person may remove a serving container from container stack 138 and use output spout 136 to pour a beverage into the serving container. The filled container may be placed on the surface of main body 102 until it is served. Spilled beverages would drain through drainage holes 108 to maintain a sanitary operating surface of main body 102.

Figure 4:
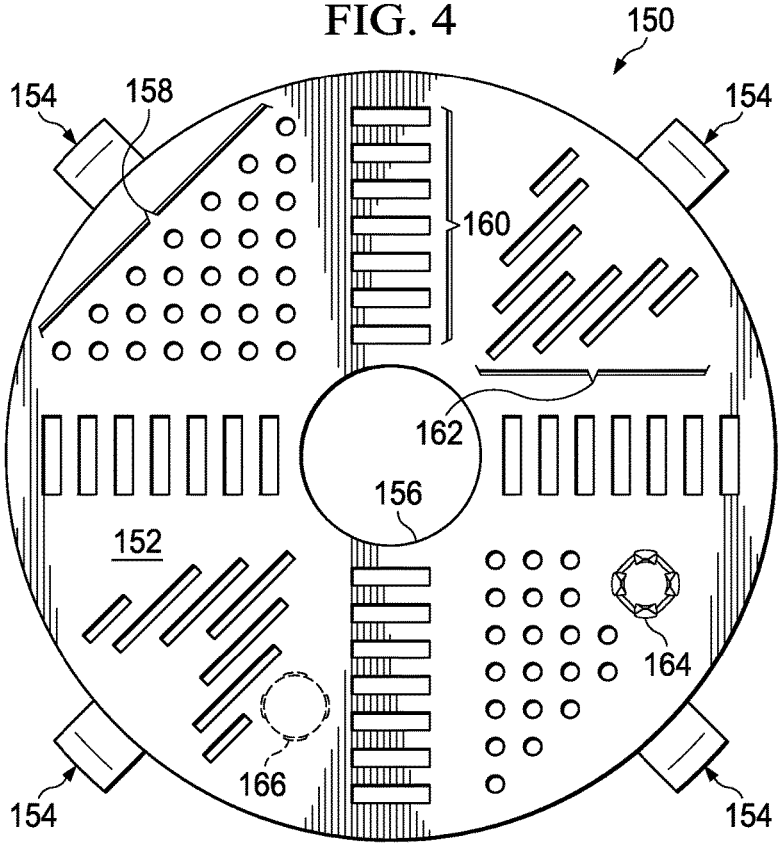
FIG. 4 is a top view of a second embodiment.
Figure 5:
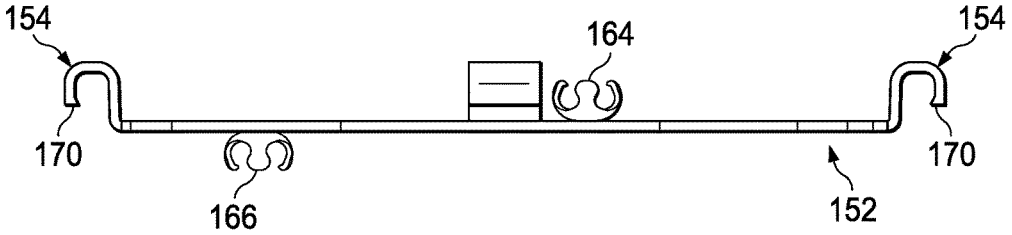
FIG. 5 is a side view of the second embodiment.

Another embodiment of the invention is shown in FIGS. 4 and 5. Cover 150 includes a main body 152. Main body 152 may be constructed of a metal plate, reinforced plastic, or any other material to provide sufficient strength to support item associated with the use of the cover 150. For example, main body 152 may be constructed with a sanitary grade reinforced plastic that provides sufficient structural support and cleanliness for beverage service items such as cups, pitchers, and ice containers.

Hooks 154 are located at the exterior edge of main body 152. As shown in FIG. 5, hooks 154 are shown with protrusions 170 which may aid in maintaining the position of cover 150 and preventing accidental removal of hooks 154. Similar to the above embodiment, hooks 154 may be constructed as a single form with main body 152 or may be permanently or removably attached by any means. In addition, hooks 154 and main body 152 may be designed to allow adjustment to fit containers with varying dimensions.

The main body 152 includes opening 156 which provides access to components of the liquid dispenser (not shown). Main body 152 also includes a drainage system with a variety of drainage options to prevent spilled liquids from gathering on the useable surface. In this embodiment, drainage options include the drainage holes 158, the drainage slots 160, and offset drainage slots 162. One skilled in the art will recognize that the selection of drainage options and designs may vary and remain within the scope and spirit of the disclosure.

This embodiment also includes accessory supports 164 and 166 located on main body 152. In this embodiment, accessory support 164 is designed as a container holder to support a stack of empty containers (not shown) for use in serving the selected liquid. As shown in FIG. 5, accessory support 164 comprises a raised set of prongs that bow outward from center such that the bowed exterior of accessory support 164 provides pressure against the interior of an empty container (not shown) to help prevent the container from tipping over. In addition, accessory support 166 is designed as a container holder to support either a second stack of empty containers (not shown) for use in serving the selected liquid or a filled serving container. Accessory support 166 comprises a lowered set of prongs that curve inward at the extremities such that the curved extremities of accessory support 166 provide pressure against the exterior of a container (not shown) to help prevent the container from tipping over. Similar to hooks 154, accessory supports 164 and 166 may be constructed as a single form with main body 152 or may be permanently or removably attached by any means.

Figure 6:
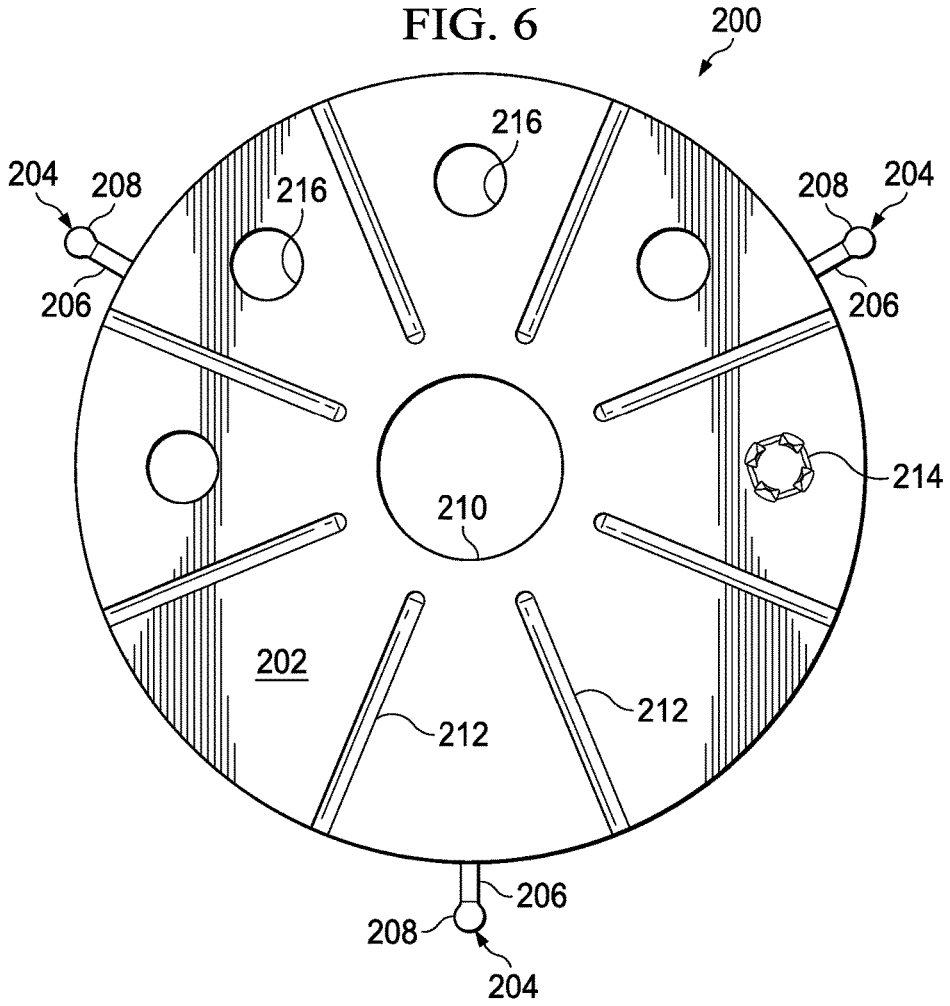
FIG. 6 is a top view of a third embodiment.
Figure 7:
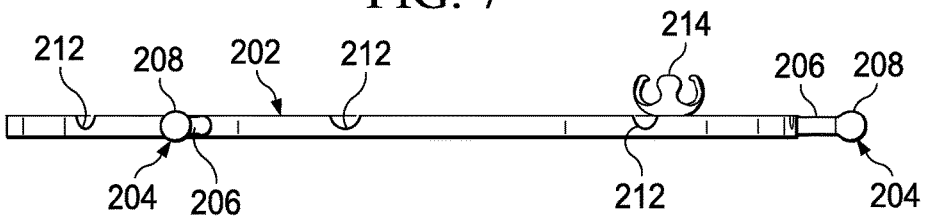
FIG. 7 is a side view of the third embodiment.
Figure 8:
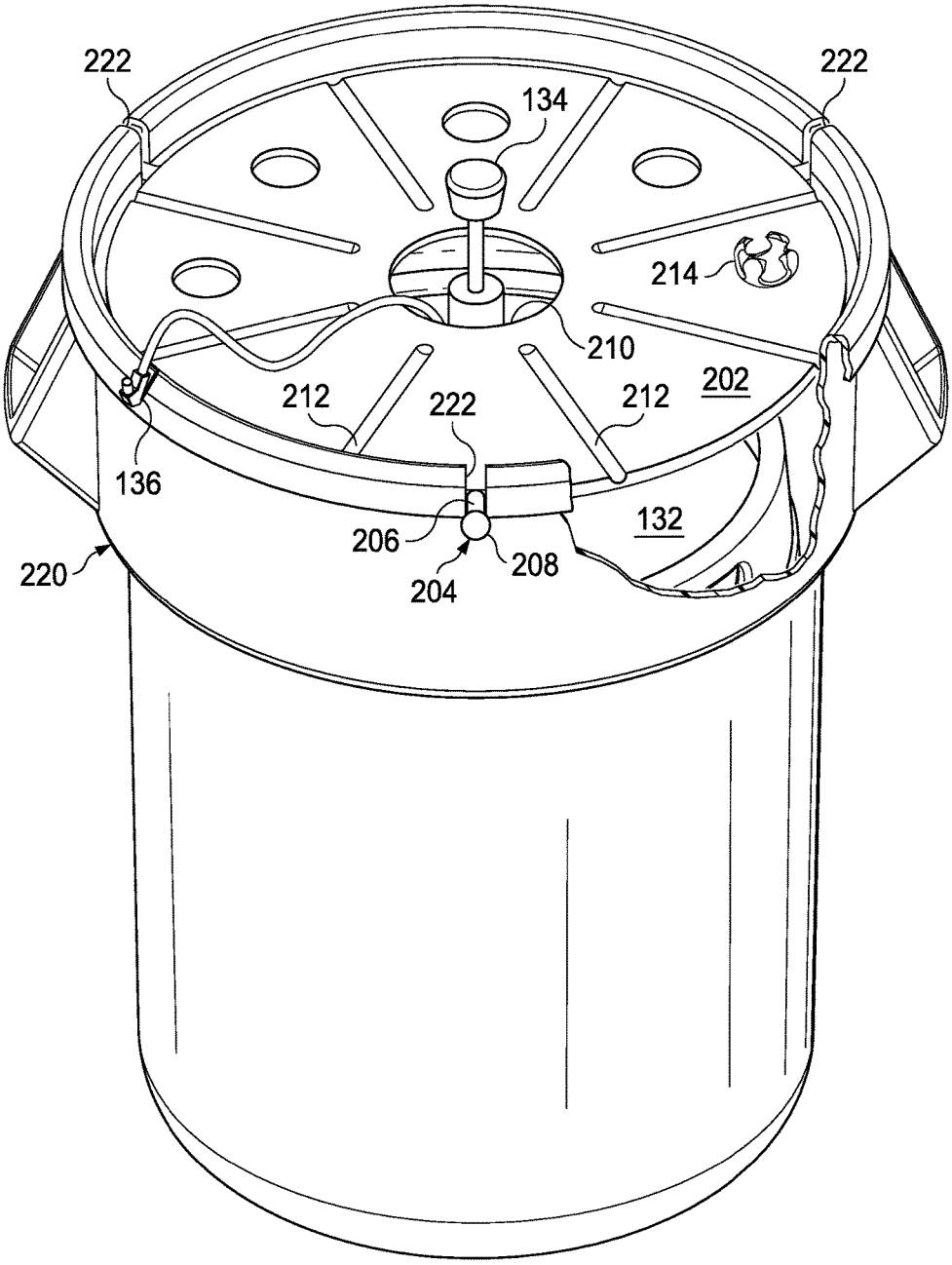
FIG. 8 is a perspective view of the third embodiment engaged with a receptacle.

Another embodiment of the invention is shown in FIGS. 6, 7, and 8. Cover 200 includes a main body 202. Main body 202 may be constructed of a metal plate, reinforced plastic, or any other material to provide sufficient strength to support item associated with the use of the cover 202.

On the exterior edge of main body 202 are three prongs 204. Each prong 204 has an extension member 206 and a cap 208 such that the cap 208 is wider than the extension member 206. As shown in FIG. 7, prongs 204 are generally in the same plane as the cover 200. Prongs 204 may be constructed as a single form with main body 202 or may be permanently or removably attached by any means. In addition, prongs 204 and main body 202 may be adjustable to fit containers with varying dimensions.

The main body 202 includes opening 210 which provides access to components of the liquid dispenser (not shown). Main body 202 also includes drainage options to prevent spilled liquids from gathering on the useable surface. In this embodiment, drainage options include the drainage channels 212. As shown in FIG. 7, drainage channels 212 may extend to the edge of main body 202 to allow liquid to flow off of cover 200. Drainage channels 212 may have a declined gradient such that liquids will flow down the gradient to the exterior of main body 202. One skilled in the art will recognize that the design of drainage channels may vary the direction of liquid flow and destination of any liquid and remain within the scope and spirit of the disclosure.

This embodiment also includes accessory support 214 located on main body 202. In this embodiment, accessory support 202 is designed as a container holder to support a stack of empty containers (not shown) for use in serving the selected liquid. As shown in FIG. 7, accessory support 214 comprises a raised set of prongs that bow outward from center such that the bowed exterior of accessory support 214 provides pressure against the interior of an empty container (not shown) to help prevent the container from tipping over.

In addition, main body 202 includes holes 216 which may be used as part of a drainage system or as accessory holders. For example, holes 216 may be used to hold filled serving containers.

FIG. 8 depicts cover 200 placed within receptacle 220 which is shown with a cut-away section. Cover 200 is held in place by prongs 204 engaged with slots 222 in receptacle 220 to create a fitted connection between cover 200 and receptacle 220. One skilled in the art will recognize that other connections may be used and remain within the scope of the disclosure. The wider caps 208 help prevent the cover 200 from sliding out of slots 222. The depth of slots 222 in receptacle 220 may provide for a cover 200 to be recessed within receptacle 220. One skilled in the art will recognize that the manner in which the cover 200 is attached to a container or receptacle may vary and remain within the scope and spirit of the disclosure.

Drainage channels 212 are shown extending to the edge of main body 202 within receptacle 220. Spilled beverages would flow down drainage channels 212 and to the edge of main body 202 and into receptacle 220 to maintain a sanitary operating surface of main body 202.

The invention being thus described, it will be obvious that the same may be varied in many ways. Such variations are not to be regarded as a departure from the spirit and scope of the invention and all such modifications as would be obvious to one skilled in the art are intended to be included within the scope of the apparatus described.

What is claimed is:

1. An apparatus for covering a liquid dispensing container and providing a usable surface for serving a liquid from said liquid dispensing container into a cup or a serving container comprising:

a main body having a top surface that is flat and a fixed shape which covers a majority of said liquid dispensing container, wherein said liquid dispensing container comprises a liquid container and a dispenser operable to facilitate dispensing the liquid from said liquid container and wherein said liquid container has a top and said top is below said main body;

an attachment element connected to said main body, wherein said attachment element enables attachment to a receptacle having a receptacle top edge and said receptacle holds said liquid dispensing container, and wherein said attachment element comprises at least three separate hooks extending from an exterior edge of said main body and each said hook extends vertically upward above said top surface then outward from said main body and then downward and said hooks support said main body at a recessed position within said receptacle when said apparatus is attached to said receptacle;

an access opening in the main body which provides an opening to the ambient through said top surface, and is sized to allow at least one operable component of said dispenser to be accessible via said access opening;

drainage elements integrated into the main body comprising a plurality of holes through said main body which are open to the ambient and allow said liquid to drain into said at least one of said liquid dispensing container and said receptacle holding said liquid dispensing container, and wherein said plurality of holes are each significantly smaller than said access opening and are configured to allow said top surface to operate as said usable surface; and an accessory support which facilitates support of an accessory, wherein said accessory support comprises a plurality of fixed prongs extending from said top surface of said main body that are designed to collectively provide pressure on said accessory and wherein said accessory is independent from said apparatus.

2. The apparatus according to claim 1, wherein a pump handle and an output component of said dispenser extend from said top of said liquid container and through said access opening which is above said top of said liquid container.

3. The apparatus according to claim 1, wherein at least one of said hooks includes a protrusion.

4. The apparatus according to claim 1, wherein said hooks comprise a fitted connection associated with the design of said receptacle.

5. The apparatus according to claim 1, wherein said fixed prongs are designed to provide an outward pressure on an interior surface of a serving container.

6. The apparatus according to claim 1, wherein said drainage elements comprise a plurality of fixed channels in said main body.

7. The apparatus according to claim 6, wherein said channels have a gradient decline below the top surface of said main body to an edge of said main body.

8. The apparatus according to claim 1, wherein said hooks are adjustable to fit variable dimensions.

9. An apparatus for covering a beverage container and a beverage dispenser in a receptacle having a top which is open and providing a usable surface for serving a beverage from said beverage container into a cup or serving container comprising:

a main body comprising a fixed body which is shaped to fit within the top of said receptacle and to cover a majority of said beverage container and said beverage dispenser, wherein said beverage container includes a top surface and said receptacle includes a top edge and at least three slots;

at least three separate prongs extending from said outer edge of said main body, wherein said prongs are configured to correspond with said slots and enable attachment of said main body to said receptacle with said main body positioned above said top surface of said beverage container;

an access opening in said main body open to the ambient, wherein said access opening is sized to allow components of said beverage dispenser that extend above said top surface of said beverage container and which facilitate dispensing the beverage from said beverage container to be accessible via said access opening;

a serving container support connected to said main body comprising at least one fixed prong extending from said main body which is designed to provide pressure on a serving container, and wherein said serving container is independent from said apparatus; and a drainage system integrated into said main body comprising a plurality of fixed channels having a gradient decline to an edge of said main body, wherein said drainage system facilitates said liquid draining from said top surface into said receptacle via openings to the ambient comprising a space between said edge of said main body and an interior wall of said receptacle and is configured to allow said top surface of said main body to operate as said usable surface.

10. The apparatus according to claim 9, wherein said drainage system further comprises a plurality of holes through said main body that are open to the ambient and allow said beverage to drain through said main body and are configured to allow said top surface of said main body to operate as said usable surface.

11. The apparatus according to claim 9, wherein said prongs are adjustable to fit variable dimensions.

12. An apparatus for serving beverages comprising:

a receptacle having a top opening and a top edge around said top opening;

a beverage container located within said receptacle, wherein said beverage container has a top surface and said beverage container is independent from said receptacle;

a beverage dispensing device operationally associated with said beverage container having an element extending above said top surface of said beverage container; and a cover comprising:

a main body comprising a planar top surface configured to be a usable surface for serving said beverages and a fixed body which is shaped to fit within the top opening of said receptacle, wherein said fixed body covers a majority of said beverage container;

an attachment element, wherein said attachment element enables removable attachment of said cover to said receptacle, wherein said attachment element comprises at least three separate hooks extending from an exterior edge of said main body and wherein said hooks position said main body below said top edge of said receptacle and above said top surface of said beverage container and are configured to fit said top edge of said receptacle wherein said hooks extend upward from said main body on an inside of said receptacle, outward from said main body over the top edge of the receptacle and downward on an outside of the top edge of said receptacle;

an access opening through said main body, wherein said access opening is sized to allow said element of said beverage dispensing device to be at least partially accessible via said access opening;

a serving container support, wherein said serving container support comprises at least one fixed prong which extends from said planar top surface of said main body and is designed to provide pressure on a serving container and wherein said serving container is independent from said apparatus; and a drainage system integrated into said main body comprising a plurality of holes to the ambient through said main body, wherein said drainage system facilitates said liquid draining into said receptacle via said plurality of holes, and wherein said plurality of holes are substantially smaller than said access opening and configured to allow said top surface to operate as said usable surface.

13. The apparatus according to claim 12, wherein said element of said beverage dispensing device comprises a pump and a beverage output spout, wherein said pump and said beverage output spout are accessible through said access opening.

14. The apparatus according to claim 12, wherein said drainage system further comprises a plurality of channels in said main body.

15. The apparatus according to claim 1, wherein said main body, said attachment element and said accessory support are constructed as a single form.

16. The apparatus according to claim 9, wherein said main body, said attachment element and said serving container support are constructed as a single form.

* * * * *